US010125440B1

(12) United States Patent
Jackson

(10) Patent No.: US 10,125,440 B1
(45) Date of Patent: Nov. 13, 2018

(54) MULTI-NEEDLE THREADER

(71) Applicant: Elizabeth Norris Jackson, Houston, TX (US)

(72) Inventor: Elizabeth Norris Jackson, Houston, TX (US)

( * ) Notice: Subject to any disclaimer, the term of this patent is extended or adjusted under 35 U.S.C. 154(b) by 0 days.

(21) Appl. No.: 15/275,341

(22) Filed: Sep. 24, 2016

Related U.S. Application Data

(63) Continuation-in-part of application No. 29/560,342, filed on Apr. 5, 2016, now Pat. No. Des. 809,776.

(51) Int. Cl.
*D05B 87/00* (2006.01)
*D05B 87/02* (2006.01)
*A41G 5/00* (2006.01)

(52) U.S. Cl.
CPC ..... *D05B 87/02* (2013.01); *A41G 5/0086* (2013.01)

(58) Field of Classification Search
CPC ..... D05B 91/12; D05B 91/14; D05B 91/16; D05B 87/00; D05B 87/02; A41G 5/0053; A41G 5/006; A41G 5/0086
USPC ..... 223/99, 106, 107, 109 R
See application file for complete search history.

(56) References Cited

U.S. PATENT DOCUMENTS 2,042,947 A * 6/1936 Lewis ..... D05B 91/14 242/137
4,489,865 A * 12/1984 Wriedt ..... D05C 1/065 223/106

* cited by examiner

*Primary Examiner* — Nathan Durham
(74) *Attorney, Agent, or Firm* — Karen B. Tripp

(57) ABSTRACT

A multi-needle threader for use in weaving hair extensions. The threader has an "L" shaped body for holding at least one spool of thread in proximity to a plurality of needles held in pin cushions. The needles and pin cushions are positioned on the threader such that the needles can be threaded in a sequence or order continuously one needle to another until all are pre-threaded for use and then the needles can be used in reverse order without unthreading any unused needles.

9 Claims, 8 Drawing Sheets

MULTI-NEEDLE THREADER

RELATED APPLICATION

The present application claims priority from U.S. Design patent application No. 29/560,342, filed Apr. 5, 2016, pending.

BACKGROUND OF THE INVENTION

1. Field of the Invention

The present invention relates to a threader for threading needles for use in weaving hair extensions into hair.

2. Description of Relevant Art

Hair extensions enable persons with thinning hair, or with short hair but with the desire for long hair, to enhance the thickness, fullness, and length of the look of their hair. Consequently, hair extensions have gained in popularity and a number of ways have been developed for applying them. One popular method of applying hair extensions is by weaving wefts of hair, comprised of natural or synthetic hair, into a person's hair. Hair weaving is done by using a needle and a thread, just like sewing a cloth.

In the prior art, one first cuts off a piece of thread and threads a needle, typically a "C" shaped needle, and then ties the ends of the thread together. One is then ready to begin the weaving. Since one cannot or should not use thread so long that it becomes tangled during the weaving, one workable length of thread—such as for example, an arm's length of thread—is not usually enough to complete the job of securing the hair extensions in and to a person's hair—thus, repeated threading of the needle is needed. Threading the needle takes time and can be difficult to do. The effort and time involved is compounded by the need to thread the needle multiple times in applying hair extensions.

Various methods and equipment have been devised to alleviate the delays and efforts involved in repeated threading of a needle for use in weaving hair extensions to hair. U.S. Pat. No. 9,033,196 B1, issued May 19, 2015 to Smith, teaches a pre-threaded and knotted needle with a length of thread knotted through the eye of the needle and a connection securing the ends of the thread and a sleeve securing a bundle of the thread. The bundle is said to prevent the thread from tangling until released and ready for use. The bundle is said to be released for use by pulling on the needle and the end of the thread to release the bundle of thread. The pre-threaded and knotted needles are said to reduce the time required for hair weaving and to increase the efficiency of the hair weaver. For use, this patent indicates that a hair stylist or professional hair weaver opens a package of pre-threaded and knotted needles and begins sewing, and then disposes of the needles when the thread is exhausted.

SUMMARY OF THE INVENTION

The present invention provides the time saving advantage of pre-threaded needles with the flexibility of being able to easily and economically thread the needles oneself, with thread in stock, without having to purchase a large inventory of needles pre-threaded with various colors of thread. The present invention provides these advantages and benefits through a multi-needle threader of the invention.

The multi-needle threader of the invention is used in applying hair extensions with one spool of thread, or with multiple spools of thread. The multi-needle threader of the invention may be used for other applications as well where having multiple threaded needles available expedites a sewing, weaving, or stitching process to be done or being done by hand. One embodiment of the invention employs a single needle threader for use in combination with the multi-needle threader of the invention to further expedite the needle threading process.

In one embodiment, the multi-needle threader of the invention comprises a body having at least one spool holder for holding at least one spool of thread and multiple receivers or holes for containing pin cushions which hold needles to be threaded. The pin cushions and needles are positioned so as to allow threading of the needles in a sequence or order so that the threading is continuous one needle to another.

DETAILED DESCRIPTION OF PREFERRED EMBODIMENTS

Figure 2:
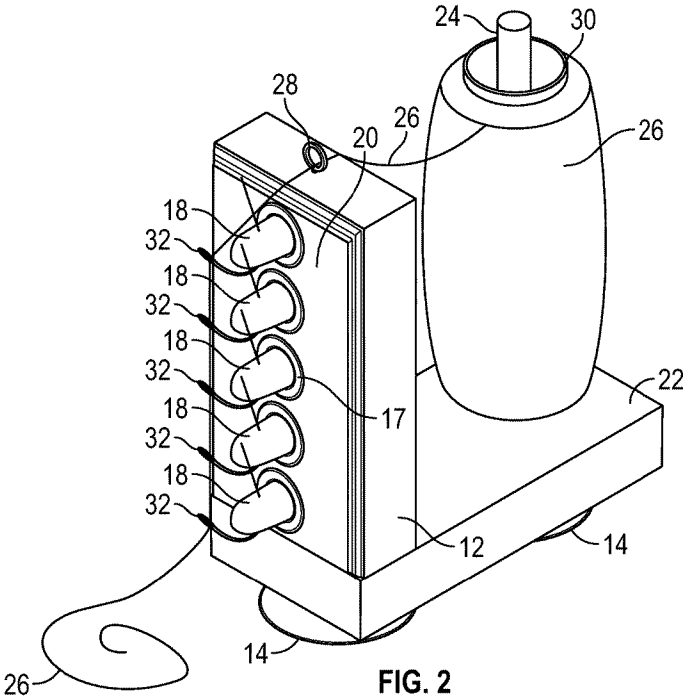
FIG. 2 is the same view as FIG. 1, showing a spool of thread and multiple needle cushions or needle holders in position on that embodiment of the multi-needle threader of the present invention.
Figure 1:
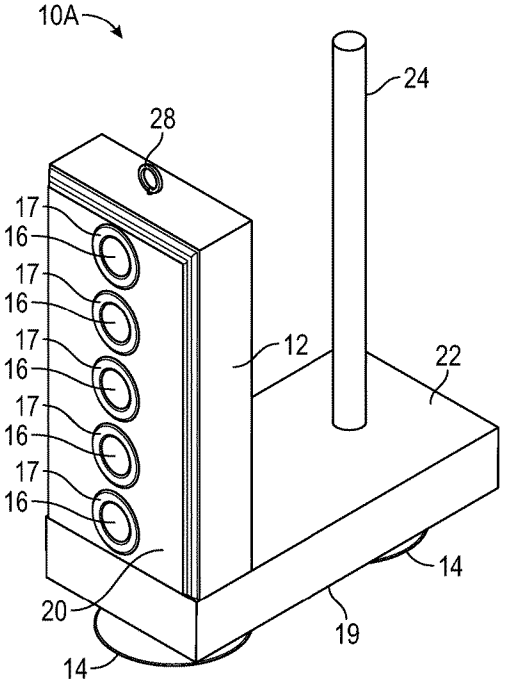
FIG. 1 is a perspective frontal side view of one embodiment of a multi-needle threader of the present invention, particularly for use with one spool of thread.
Figure 4:
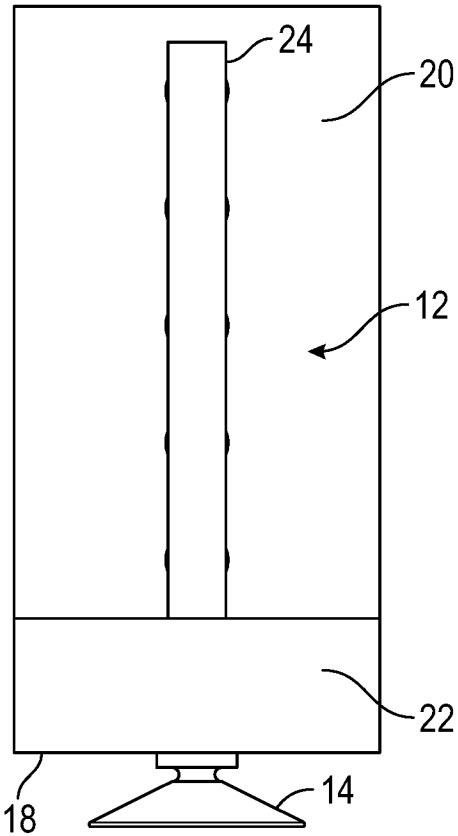
FIG. 4 is a back view of the multi-needle threader of FIG. 1.
Figure 3:
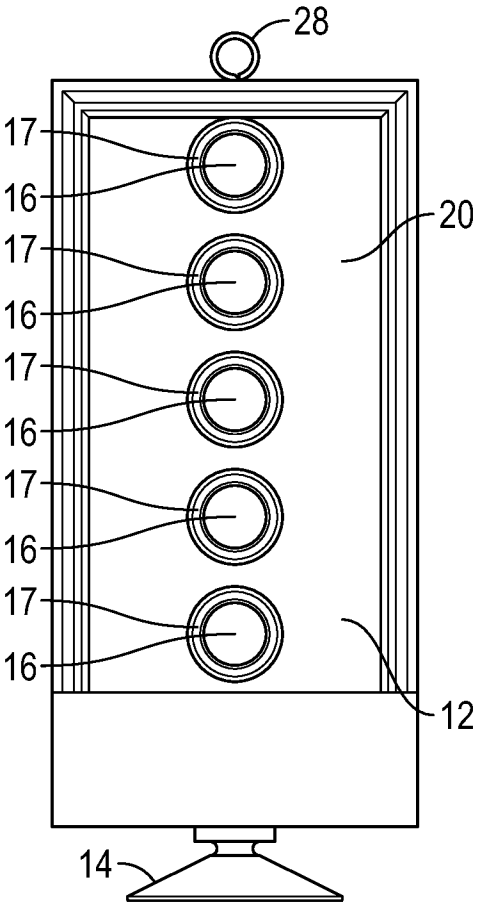
FIG. 3 is a front view of the multi-needle threader of FIG. 1.
Figure 6:
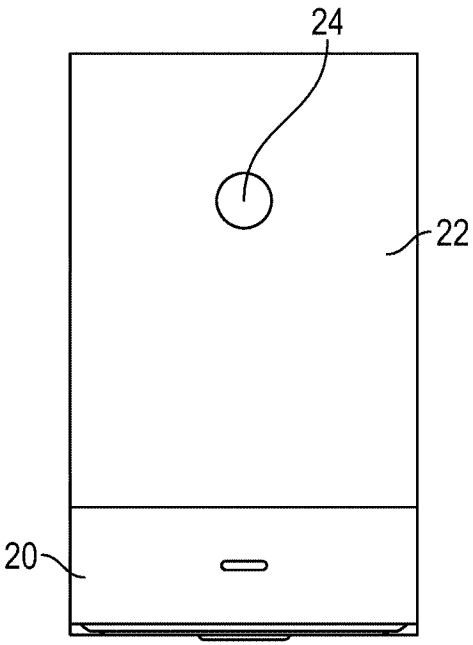
FIG. 6 is a top view of the multi-needle threader of FIG. 1.
Figure 5:
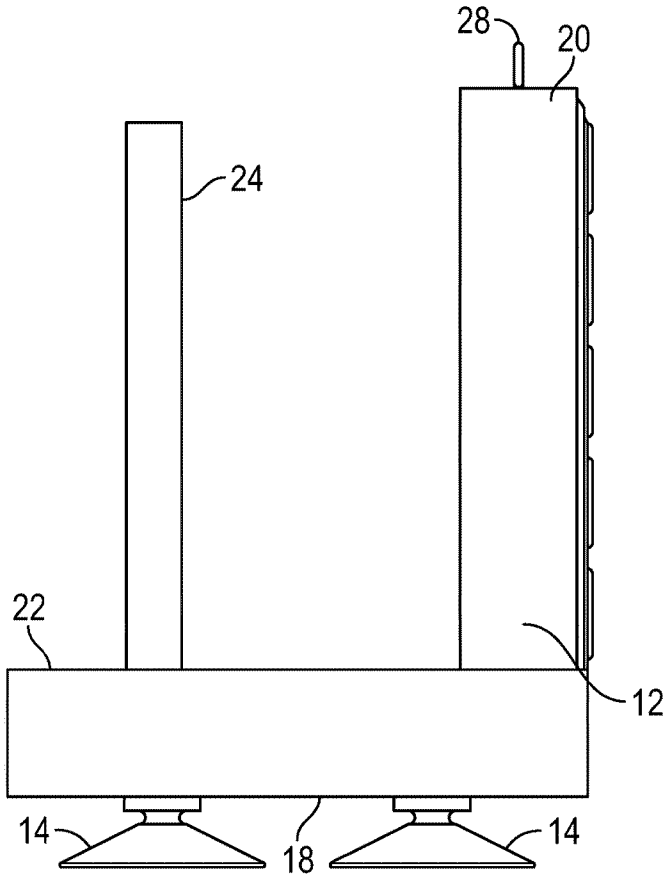
FIG. 5 is a side view of the multi-needle threader of FIG. 1; the other side is a mirror image of this side.
Figure 8:
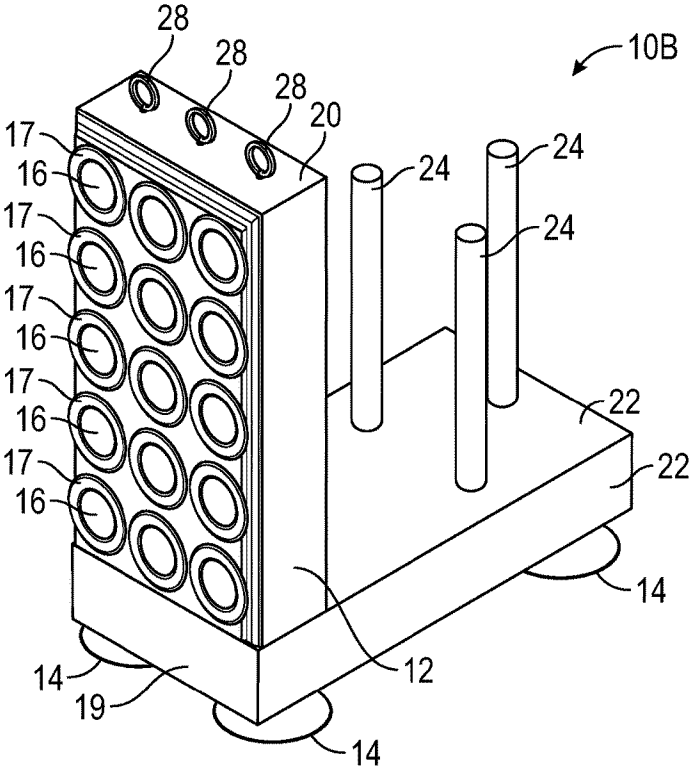
FIG. 8 is a perspective frontal side view of an alternative embodiment of a multi-needle threader of the present invention, particularly for use with multiple spools of thread.
Figure 7:
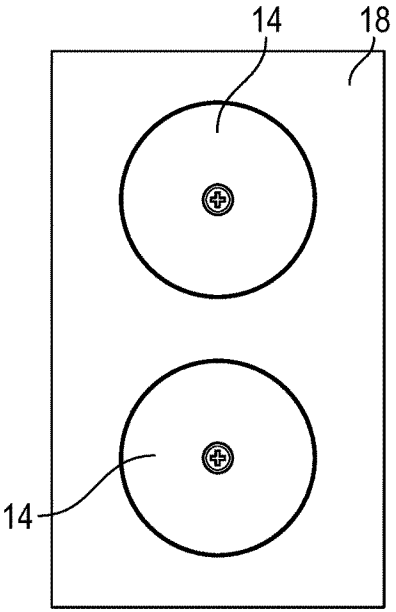
FIG. 7 is a bottom view of the multi-needle threader of FIG. 1.
Figure 10:
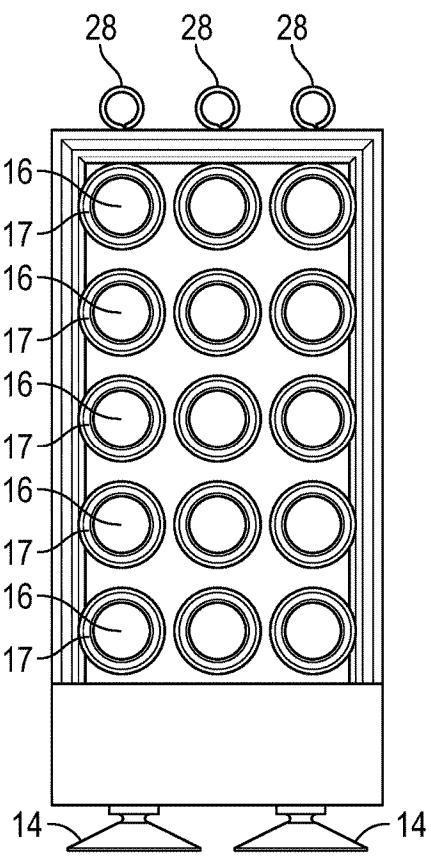
FIG. 10 is a front view of the multi-needle threader of FIG. 8.

Referring now to the drawings, it is seen that in the embodiment of the invention as shown in FIGS. 1-7, and the embodiment of the invention as shown in FIGS. 8-14, the multi-needle threader 10A and 10B respectively, comprises a generally "L" shaped body 12 sitting on at least one support such as a suction cup 14 as shown. FIGS. 1-5 and FIG. 7 show a pair of suction cups 14, with one positioned near the front of the bottom 19 of base 22 of threader 10A and one positioned near the rear of the bottom 19 of threader 10. In another embodiment, a suction cup 14 is positioned at each corner of the bottom 19 of threader 10B as shown in FIGS. 9-12 and 14. In another embodiment not shown, one suction cup 14 is positioned at the center of the bottom 19. In other embodiments not shown, still other numbers of suction cups 14 could be used, or suction cups 14 could be eliminated altogether, or an alternative support could be used to hold the multi-needle threader of the invention firmly to a table, bar, or counter. One such alternative is a hook and loop fastener such as a Velcro fastener, with the hook portion (or alternatively loop portion) on the bottom of the threader and the loop portion (or alternatively hook portion) on the surface of the table, bar, counter, or other work surface on which the threader is to be positioned. Another alternative to suction cups 14 is a strap, tie or, belt for looping around the base of the threader and the top or leg of the table, bar, counter or other work surface to hold the threader to the table, bar, counter, or other work surface. Such work surface in one embodiment could also be a wall. It is believed that the multi-needle threader of the invention will be easier to use if it is held stationary, as suction cups 14 gripping a surface such as a table will do.

Figure 9:
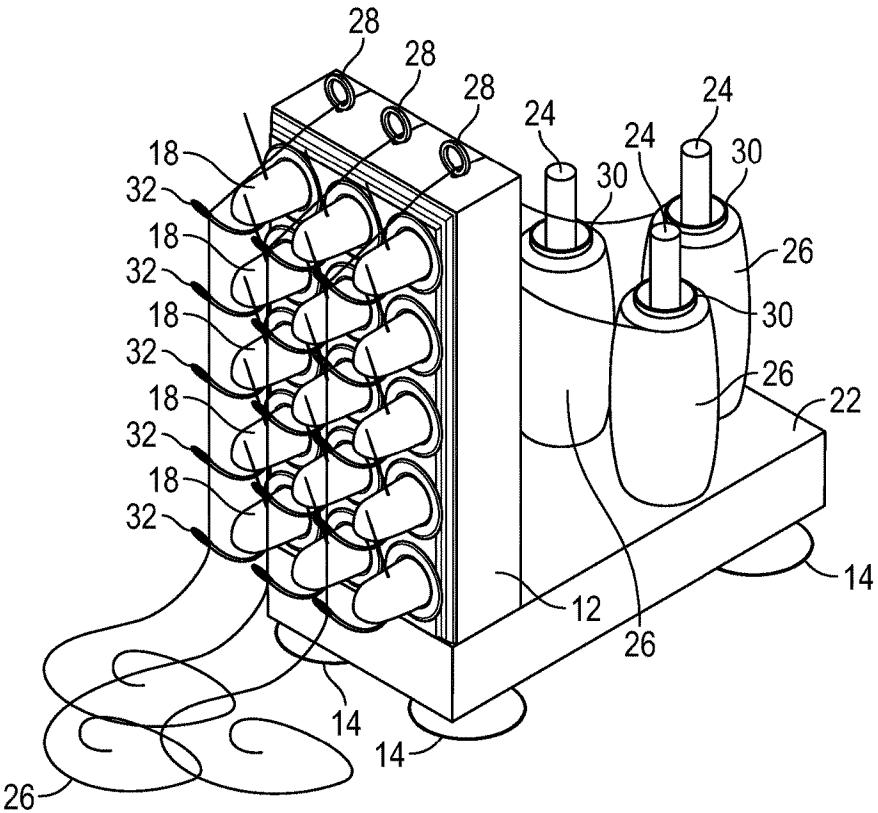
FIG. 9 is the same view as FIG. 8, showing multiple spools of thread and multiple needle cushions or needle holders in position on that embodiment of the multi-needle threader of the present invention.
Figure 12:
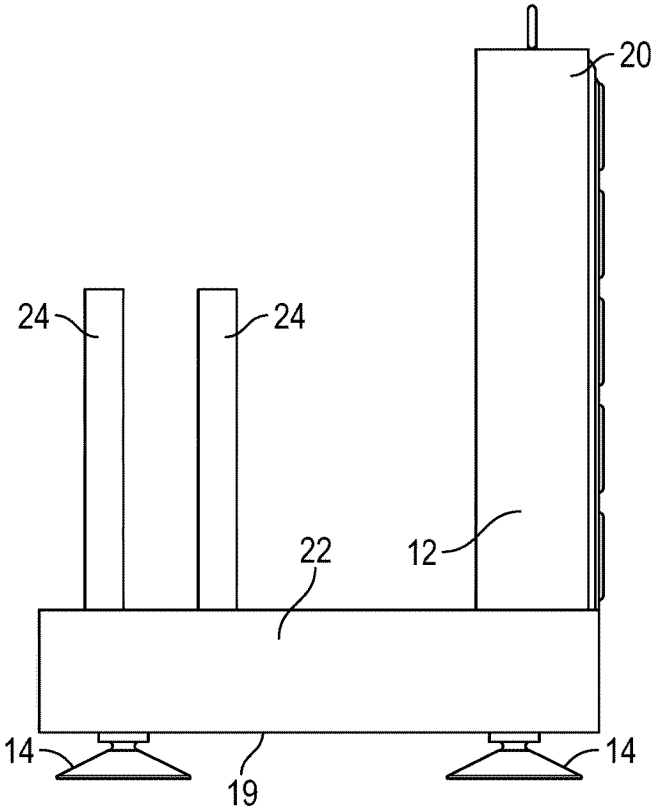
FIG. 12 is a side view of the multi-needle threader of FIG. 8; the other side is a mirror image of this side.
Figure 11:
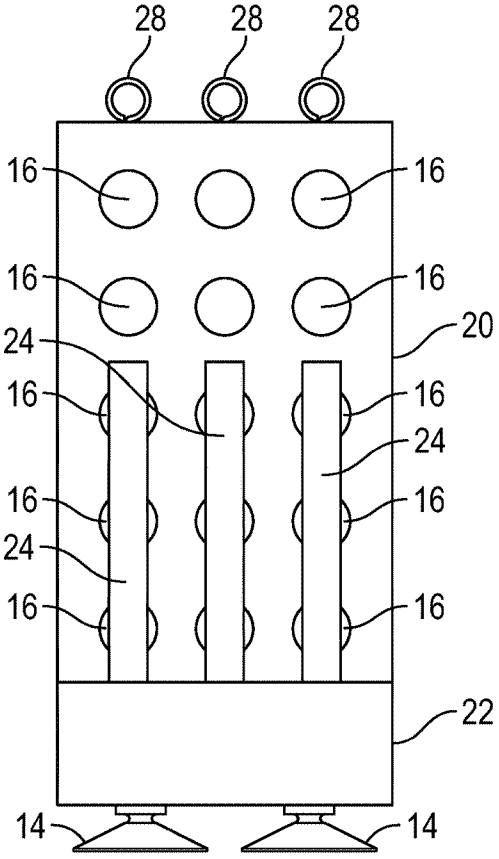
FIG. 11 is a back view of the multi-needle threader of FIG. 8.

Further the embodiments of the invention shown in FIGS. 1-7 and in FIGS. 8-14 have a plurality, series, group, row or column of cavities, indentations, or holes 16 in the side panel or vertical portion 20 of the "L" shaped body 12 for receiving pin cushions 18 as shown in FIGS. 2 and 9. The holes 16 optionally may have rings 17 surrounding the holes for aesthetic purposes and also in one embodiment to further grip the pin cushions. The pin cushions 18 are comprised of a material such as cotton or synthetic cloth filled with sand or other material that will support insertion and holding of a needle yet be flexible enough to fit tightly into the holes 16 so as not to easily fall out when a needle 20 is inserted into and removed from a pin cushion 18. A preferred shape of pin cushion 18 resembles the cylindrical shape of lipstick or a round nosed bullet, having one cylinder end flat and the other cylinder end rounded, or in another embodiment having both cylinder ends rounded.

In one embodiment, the "L" shaped body 12 of the multi-needle threader of the invention consists essentially of two pieces—a base 22 and a vertical portion 20—connected together by connectors or fasteners, such as for example nails or screws, optionally reinforced with glue. In another embodiment, the "L" shaped body 12 of the threader of the invention consists essentially of one piece, with the base 22 and the vertical portion 20 molded or formed for example of one piece. In either embodiment, the "L" shaped body is made of plastic or glass or plexiglass or metal or natural wood or synthetic wood or clay or Lucite or bamboo, or some combination of these materials, or any similar material that is capable of performing the function of multi-needle threaders 10A and 10B of the invention.

Extending vertically from base 22 is at least one bar or rod 24 for receiving and holding at least one spool 30 of thread 26. The bar or rod 24 is inserted into or through a hole or indentation in the base 22 for receiving the bar or rod 24 in one embodiment, and is optionally also glued and/or screwed, nailed, or similarly fastened or attached to the base 22 so that the bar or rod 24 remains upright or vertical during use of the multi-needle threaders 10A and 10B. In another embodiment, the bar or rod 24 is glued and/or screwed, nailed or similarly fastened or attached to the base 22 so that the bar or rod 24 remains upright or vertical in use of the multi-needle threader of the invention without insertion of the bar or rod 24 into a hole or indentation in the base 22. The bar or rod 24 is comprised of the same material as the "L" shaped body 12 or of a similar or different material. Generally, any material suitable for the "L" shaped body 12 would be suitable for the bar or rod 24. In one embodiment, the bar or rod 24 is formed or molded as part of the base 22 while in other embodiments, the bar or rod 24 is a separate piece, attached as discussed above. The height of the bar or rod 24 is sufficient to support or hold spool 30 of thread 26.

The multi-needle threaders 10A and 10B of the invention preferably have one or more guides 28 for directing thread 26 from spool 30 on bar or rod 24 to needles 32 protruding from pin cushions 18. Such guide 28 is a hollow ring for example as shown in FIGS. 1-3 and 8-11, or guide 28 is an indentation or trough or channel across the top of the vertical portion 20 generally where the FIGS. 2 and 9 show the thread on the top of the vertical portion 20. In one embodiment, the hollow ring used as guide 28 shown in the FIGS. 1-3 and 8-11 is an eye bolt screwed into the vertical portion 20.

In the preferred method of use of the multi-needle threader of the invention, the external end of thread 26 is drawn from the spool 30 through the guide 28 and down across pin cushions 18, each preferably holding a single needle 32. The single piece of thread 26 is threaded through each needle 32 beginning with the pin cushion 18 the closest to the guide 28 and proceeding downward from that pin cushion 18 to each pin cushion 18 below. Next the thread 26 is pulled out as needed for the bottom needle 32—the needle the closest to the base 22 of the multi-needle threader of the invention—or the needle that is to be the first to be used, while allowing the needle to remain threaded. The thread is cut to separate that first needle from the other needles without unthreading any of the needles. That first needle 32 to be used is then used and when the thread in that first used needle 32 is used up or sufficiently depleted that sewing with it is no longer practical, the user goes to the pin cushion immediately above the pin cushion from which that first used needle came, and pulls thread out as needed for use of that needle, again allowing the needle to remain threaded. This pattern of use of the threaded needles is continued until the needle in the top pin cushion, the one closest to the guide, is used, or until no more needles are needed.

FIGS. 1 through 7 show a single vertical column of pin cushions 18, according to one embodiment of the invention. However, as shown for example in FIGS. 8 through 14, the invention is not limited to a single column or row of pin cushions 18. The embodiment of the invention shown in FIGS. 8 through 14 has three vertical columns of pin cushions 18, preferably with one needle each, which are each respectively threaded and used in the manner that one column is used as discussed above with respect to the embodiment shown in FIGS. 1 through 7. That is, in preferred use, the user has a needle in each pin cushion and the needles are threaded by columns with a different spool of thread for each column. In use, the user starts with the needle from the lowest or bottom pin cushion on an outermost column and works up to the needle in the top pin cushion of that column, just as discussed above for the embodiment of FIGS. 1 through 7 having a single column of pin cushions each with needles. The user then goes to the bottom cushion of the adjacent column to use the threaded needle therein and works up to the needle in the top pin cushion of that column. The user then goes to the bottom cushion of the adjacent column to use the threaded needle therein and works up to the needle in the top pin cushion of that column. And this pattern repeats until the pre-threaded needles are all depleted of thread or until the job requiring use of the needles is finished. Thus, as demonstrated, the invention may be useful with any number of columns and rows of pin cushions and is not limited to the exemplary embodiments shown in the Figures.

Figure 16:
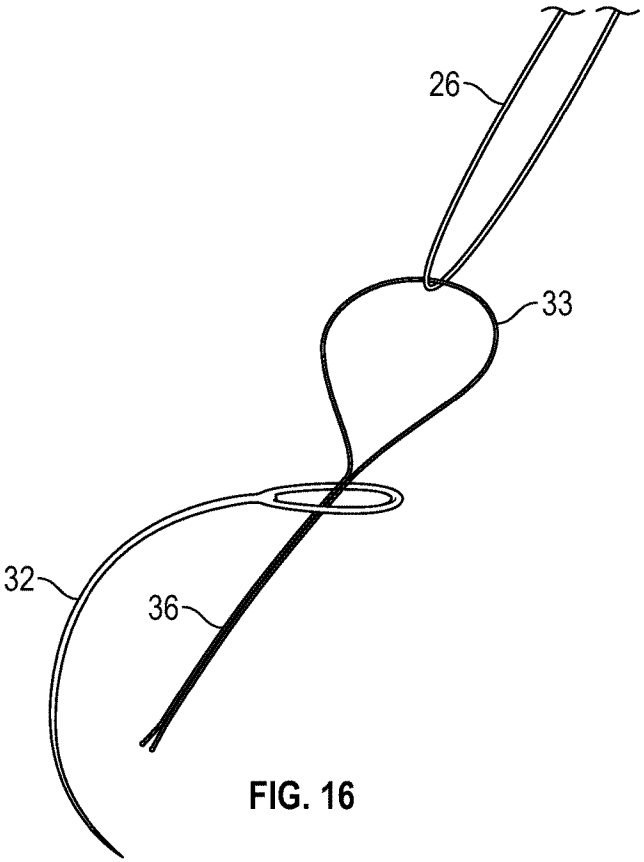
FIG. 16 is the single needle threader of FIG. 15 shown in use with a needle and thread.

The positioning of the needles 32 in the pin cushions 18 can be in any convenient location. One example of such location is with the needles 32 positioned in the pin cushions 18 effectively in a column as shown in the embodiment of FIG. 2 or in columns and rows as shown in the embodiment of FIG. 9. The needles 32, if curved for example as shown in FIGS. 2 and 9, are positioned in the pin cushions in one embodiment with the eye of each needle pointing sideways as shown in FIGS. 2 and 9. Alternatively, the needles 32, if curved for example as shown in FIGS. 2 and 9, can be positioned in the pin cushions with the eye of each needle pointing downward as shown in FIG. 16, or with the eye of each needle pointing upward (as not shown). The needles 32 can also further alternatively be used in the pin cushions where the needles are projecting from the pin cushions 18 at different angles one from the other. And the multi-needle threaders 10 and 10A of the invention can be used with straight needles as well as or as an alternative to curved needles. Users will likely vary in their preference for placement of the needles 32 in the pin cushions 18.

Figure 17:
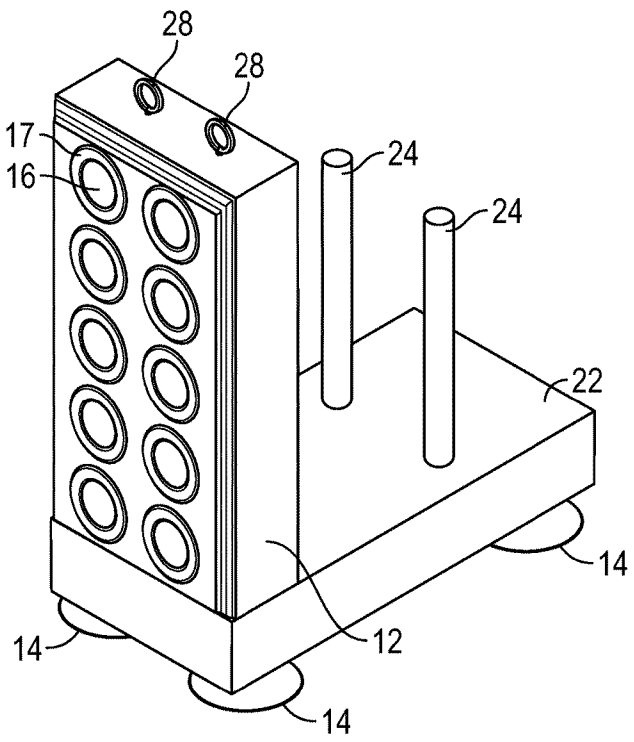
FIG. 17 is a perspective frontal side view of an another alternative embodiment of a multi-needle threader of the present invention, particularly for use with a two spools of thread.

The number of rows and columns of pin cushions shown in the Figures is believed particularly useful for the number of pre-threaded needles commonly needed for weaving hair extensions for one person. For another non-limiting example, an embodiment shown in FIG. 17 having two vertical columns, particularly with five pin cushions in each column, is believed also particularly useful for providing threaded needles for weaving hair extensions.

However, the principles of the invention are applicable to other uses where pre-threaded needles are needed or desired. The "L" shaped body 12 shown in the Figures is one non-limiting example of a suitable body for the invention, but the body of the invention is readily adaptable to other shapes. That is, in alternative embodiments, the base 22 is oval or circular or square or oblong, or polygonal or amorphous in shape, so long as the base is capable of holding at least one spool of thread. Similarly in alternative embodiments, the vertical piece 20 has such varying shapes as well, so long as the shape allows or affords the pin cushions to be positioned for ease of use with threading of multiple needles using the an unbroken thread attached at one end to a spool of thread, or otherwise coming from a spool of thread, positioned on the base of the multi-needle threader. In some embodiments, the vertical piece 20 is not vertical, but rather is slanted or at an angle extending obtusely or acutely from or with respect to the base 22.

Figure 15:
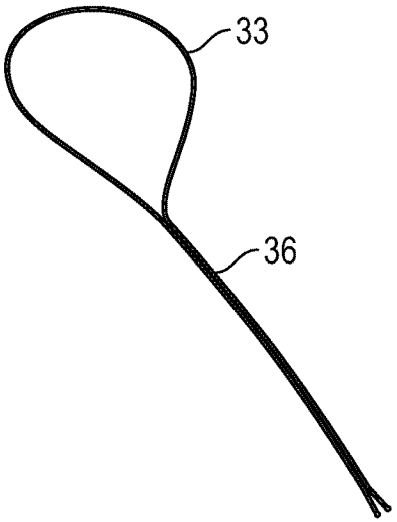
FIG. 15 is a single needle threader for optional use with the multi-needle threader of the present invention.
Figure 14:
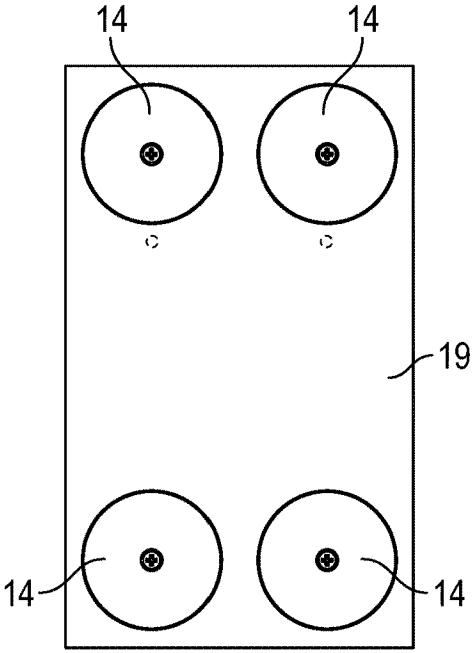
FIG. 14 is a bottom view of the multi-needle threader of FIG. 8.
Figure 13:
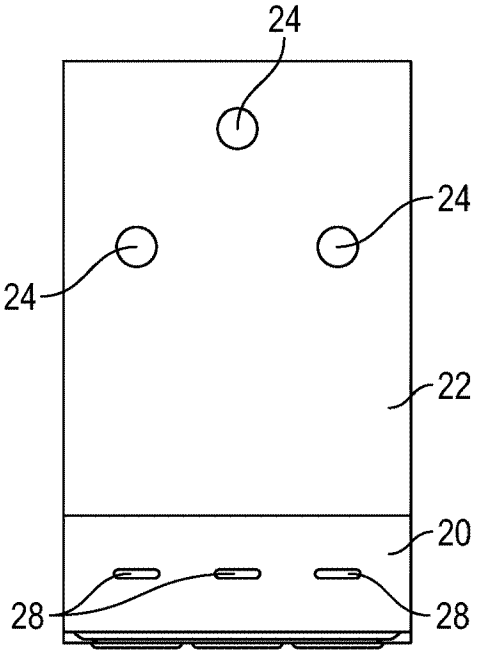
FIG. 13 is a top view of the multi-needle threader of FIG. 8.

FIGS. 15 and 16 show a single needle threader 36 of the invention that may be used to assist with threading the needles in the pin cushions of the multi-needle threader of the invention. This single needle threader 36 is comprised of thin, flexible material, such as plastic commonly used for a dental floss threader, enabling the single needle threader to entirely go through the eye of a needle 32, beginning first with the loop end 33 of the single needle threader 36, taking with it thread 26 looped around the loop end 33 of the single needle threader 36 as shown in FIG. 16, such that when the loop end 33 is in the eye of the needle 32, the needle 32 becomes threaded with the thread 26 and the single needle threader 33 can be pulled out of the eye of the needle 32, leaving the needle 32 threaded.

While preferred embodiments of the present invention have been described, it should be understood that other various changes, adaptations and modifications can be made therein without departing from the spirit of the invention(s) and the scope of the appended claims. The scope of the present invention should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

What is claimed is:

1. A method for threading and using pre-threaded multiple needles for weaving hair extensions, the method comprising:

providing an "L" shaped body comprising a horizontal base having at least one spool holder thereon and a vertical portion having multiple receivers or holes therein configured in at least one column and each containing a pin cushion, sized to fit the receiver or hole, such that there are at least first, second, and third pin cushions in holes in the at least one column;

providing at least one needle for each pin cushion such that there are at least first, second, and third needles corresponding to the first, second and third pin cushions;

inserting the at least one needle in each pin cushion such that the first needle is inserted in the first pin cushion, the second needle is inserted in the second pin cushion, and the third needle is inserted in the third pin cushion for weaving hair extension;

positioning on said at least one spool holder at least one spool of thread for weaving hair extensions;

pulling thread from the spool of thread to the first pin cushion in the column and threading the first needle in the first pin cushion;

without unthreading the first needle in the first pin cushion, pulling thread to the second pin cushion in the column and threading the second needle in the second pin cushion;

without unthreading the needles in the first and second pin cushions, pulling thread to the third pin cushion in the column and threading the third needle in the third pin cushion;

pulling the thread in that third needle out a length for use in weaving hair extensions without tangling and then cut the thread without unthreading said third needle or the needles in the first and second pin cushions;

using said third needle for weaving hair extensions until the thread is depleted in that third needle;

pulling the thread in the second needle out a length for use in weaving hair extensions without tangling and then cut the thread without unthreading said second needle or said first needle;

using said second needle for weaving hair extensions until the thread is depleted in that second needle;

pulling the thread in the first needle out a length for use in weaving hair extensions without tangling and then cut the thread without unthreading said first needle;

using said first needle for weaving hair extensions until the weaving of the hair extensions is complete or until the thread is exhausted.

2. The method of claim 1 further comprising using a single needle threader to thread the needles, wherein the single needle threader comprises a loop of thin, flexible plastic capable of passing through the eye of each needle and thread is wrapped around the loop and the loop is passed through the eye of the needle to thread the needle.

3. The method of claim 1 further comprising holding said body stationary during use.

4. The method of claim 3 wherein said body comprises at least one suction cup to facilitate holding said body stationary during use.

5. The method of claim 1 wherein the holes in the column are sequential and single-file and the hole for the first needle is the hole nearest the spool.

6. The method of claim 5 further comprising:

providing a fourth pin cushion in a hole in the at least one column and a fourth needle for insertion into that hole;

inserting the fourth needle in the fourth pin cushion;

and after threading the third needle in the third pin cushion, without unthreading the first, second and third needles, and before using the third needle for weaving hair extensions, pulling thread to the fourth pin cushion in the column and threading the fourth needle in the fourth pin cushion and then pulling the thread in that fourth needle out a length for use in weaving hair extensions without tangling and then cut the thread without unthreading said fourth needle or the needles in the first, second, and third pin cushions, using said fourth needle for weaving hair extensions until the thread is depleted in that fourth needle.

7. The method of claim 6 further comprising:

providing a fifth pin cushion in a hole in the at least one column and a fifth needle for insertion into that hole;

inserting the fifth needle in the fifth pin cushion;

and after threading the fourth needle in the fourth pin cushion, without unthreading the first, second, third and fourth needles, and before using the fourth needle for weaving hair extensions, pulling thread to the fifth pin cushion in the column and threading the fifth needle in the fifth pin cushion and then pulling the thread in that fifth needle out a length for use in weaving hair extensions without tangling and then cut the thread without unthreading said fifth needle or the needles in the first, second, third and fourth pin cushions, using said fifth needle for weaving hair extensions until the thread is depleted in that fifth needle.

8. A method for threading and using pre-threaded multiple needles for weaving hair extensions, the method comprising:

providing an "L" shaped body comprising a horizontal base having at least one spool holder thereon and a vertical portion having multiple receivers or holes therein configured in at least one column and each containing a pin cushion, sized to fit the receiver or hole, such that there are at least first, second, third, fourth, and fifth pin cushions in holes in the at least one column;

providing at least one needle for each pin cushion such that there are at least first, second, third, fourth, and fifth needles corresponding to the first, second, third, fourth, and fifth pin cushions;

inserting the at least one needle in each pin cushion such that the first needle is inserted in the first pin cushion, the second needle is inserted in the second pin cushion, the third needle is inserted in the third pin cushion, the fourth needle is inserted in the fourth pin cushion, and the fifth needle is inserted in the fifth pin cushion for weaving hair extension;

positioning on said at least one spool holder at least one spool of thread for weaving hair extensions;

pulling thread from the spool of thread to the first pin cushion in the column and threading the first needle in the first pin cushion;

without unthreading the first needle in the first pin cushion, pulling thread to the second pin cushion in the column and threading the second needle in the second pin cushion;

without unthreading the needles in the first and second pin cushions, pulling thread to the third pin cushion in the column and threading the third needle in the third pin cushion;

without unthreading the needles in the first, second and third pin cushions, pulling thread to the fourth pin cushion in the column and threading the fourth needle in the fourth pin cushion;

without unthreading the needles in the first, second, third and fourth pin cushions, pulling thread to the fifth pin cushion in the column and threading the fifth needle in the fifth pin cushion;

pulling the thread in that fifth needle out a length for use in weaving hair extensions and then cut the thread without unthreading said fifth needle or the needles in the first, second, third, or fourth pin cushions;

using said fifth needle for weaving hair extensions until the thread is depleted in the fifth needle;

pulling the thread in that fourth needle out a length for use in weaving hair extensions and then cut the thread without unthreading said fourth needle or the needles in the first, second, or third pin cushions;

using said fourth needle for weaving hair extensions until the thread is depleted in the fourth needle;

pulling the thread in that third needle out a length for use in weaving hair extensions without tangling and then cut the thread without unthreading said third needle or the needles in the first and second pin cushions;

using said third needle for weaving hair extensions until the thread is depleted in that third needle;

pulling the thread in the second needle out a length for use in weaving hair extensions without tangling and then cut the thread without unthreading said second needle or said first needle;

using said second needle for weaving hair extensions until the thread is depleted in that second needle;

pulling the thread in the first needle out a length for use in weaving hair extensions without tangling and then cut the thread without unthreading said first needle;

using said first needle for weaving hair extensions until the weaving of the hair extensions is complete or the thread is exhausted.

9. The method of claim 8 wherein the "L" shaped body comprises three columns each with five holes and the steps are repeated for each column in sequence.

* * * * *